US006840967B1

(12) United States Patent
Riggins et al.

(10) Patent No.: US 6,840,967 B1
(45) Date of Patent: Jan. 11, 2005

(54) DYE DIFFUSION PROMOTING AGENTS FOR ARAMIDS

(75) Inventors: Phillip H. Riggins, Greensboro, NC (US); John H. Hansen, Greensboro, NC (US)

(73) Assignee: Southern Mills, Inc., Union City, GA (US)

( * ) Notice: Subject to any disclaimer, the term of this patent is extended or adjusted under 35 U.S.C. 154(b) by 1826 days.

(21) Appl. No.: 08/206,405

(22) Filed: Mar. 7, 1994

Related U.S. Application Data

(60) Division of application No. 07/851,781, filed on Mar. 16, 1992, now Pat. No. 5,306,312, which is a continuation-in-part of application No. 07/606,572, filed on Oct. 31, 1990, now abandoned.

(51) Int. Cl.[7] ..... D06P 1/645
(52) U.S. Cl. ..... 8/586; 589/602; 589/925
(58) Field of Search ..... 8/586, 589 B, 8/602, 925, 115.65, 115.66, 130.1

(56) References Cited

U.S. PATENT DOCUMENTS 5,207,803 A * 5/1993 Holsten et al. ..... 8/586

FOREIGN PATENT DOCUMENTS

GB 1275459 * 5/1972 ..... D06P/3/24

* cited by examiner

*Primary Examiner*—Margaret Einsmann
(74) *Attorney, Agent, or Firm*—Thomas, Kayden, Horstemeyer & Risley, LLP

(57) ABSTRACT

Aramid and aramid-blend fabrics are dyed or flame-retardant treated or both dyed and flame-retardant treated using conventional heat dyeing equipment. Amides capable of swelling the aramid fibers at least 1.5% and preferably having 7 to 14 carbon atoms are used as diffusion-promoting agents for dyes, flame retardant agents or both. Odor-free, flame resistant, colored or colored and highly-flame resistant products result.

21 Claims, No Drawings

DYE DIFFUSION PROMOTING AGENTS FOR ARAMIDS

This is a divisional of application Ser. No. 07/851,781, filed Mar. 16, 1992 now U.S. Pat. No. 5,306,312, which is a continuation-in-part of Ser. No. 07/606,572, filed Oct. 31, 1990 now abandoned.

This invention relates to dyeing aramid fibers and/or improving the flame resistance of these fibers. Aramids and aramid blends are dyed and/or also flame-retardant treated in conventional dyeing equipment to produce an odor-free, colored, flame resistant or colored and highly-flame resistant product.

BACKGROUND OF THE INVENTION

Aramid fibers are highly resistant to heat decomposition, have inherent flame resistance, and are frequently used in working wear for special environments where flame resistance is required. Fabrics made of these fibers are extremely strong and durable, and have been widely adopted for military applications where personnel have the potential to be exposed to fire and flame, such as aircraft pilots, tank crews and the like. There is a need for dyed fabrics that have flame resistant properties even greater than the undyed fabrics or dyed fabrics. Meta-linked aromatic polyamide fibers (aramid fibers) are made from high-molecular-weight polymers that are highly crystalline and have either a high or no glass transition temperature.

These inherent desirable properties of aramid fibers also create difficulties for fiber processing in other areas; specifically, aramids are difficult to dye. Fiber suppliers currently recommend a complicated exhaust dyeing procedure with a high carrier (acetophenone) content; the process is conducted at high temperatures over long periods of time and often results in a product having an unpleasant odor. Such dyeing conditions require substantial amounts of energy both to maintain dyeing temperature and for the treatment of waste dye baths.

Polar organic solvents have also been used to swell the fiber or create voids in the fiber structure to enhance dyeability. These procedures involve solvent treatments at elevated temperatures with subsequent dyeing. Another source of dyed aramid fiber is producer-dyed aramid yarn, prepared by solution dyeing in which typically a quantity of dye or pigment is mixed with the molten or dissolved polymer prior to extrusion of the polymer or solution into fine fibers; the dye or pigment becomes part of the fiber structure. Solution-dyed fibers are more costly than the undyed fibers due, in part, to the additional costs of manufacture, and must be used in the color provided by the supplier, leaving the user with only a limited choice of colors. Solution-dyed fibers offer relatively good lightfastness, whereas some undyed aramid fibers, particularly Nomex® (DuPont) yellow following exposure to UV light.

A process has been described by Cates and others in commonly-assigned U.S. Pat. No. 4,759,770 for continuously or semi-continuously dyeing and simultaneously improving the flame-resistant properties of poly(m-phenyleneisophthalamide) fibers that includes the step of introducing the fiber into a fiber swelling agent consisting preponderantly of a polar organic solvent also containing at least one dye together with at least one flame retardant, thereby swelling the fiber and introducing both the dye and the flame retardant into the fiber while in the swollen state. The flame resistance/performance properties of fabrics dyed by this process are significantly improved. Limiting Oxygen Index (LOI) values, as described below, may be as high as 41% for simultaneously dyed and flame retarded T-455 Nomex fabric products produced by the process of this invention. As a means of comparison, undyed T-455 Nomex has an LOI of 27%. However, this process involves some equipment not routinely available on most existing processing lines.

Our earlier U.S. Pat. No. 4,898,596 describes a process for dyeing, flame-retardant treating or both dyeing and flame retardant treating aramid fabrics using N-cyclohexyl-2-pyrrolidone as a dye and/or flame retardant-diffusion promoting agent.

Our previous investigations have identified N-cyclohexyl-2-pyrrolidone, in U.S. Pat. No. 4,898,596 and the octylpyrrolidones, in Ser. No. 07/437,397 filed Nov. 16, 1989, as effective agents for promoting diffusion of dyes and/or flame retardant into aramid fibers. While highly effective for most applications, these materials are costly and presently commercially available from only a single source. We have more recently investigated other amide-type compounds and the relationship between compound structure and efficacy in promoting dyeing and/or flame resistance by durable uptake of phosphorus-containing flame retardants. We have now identified and hereby disclose a series of compounds useful for promoting the dyeing and/or flame retarding of aramid fibers or fabrics. These compounds offer the promise of reduced costs and improved effectiveness of methods of dyeing and finishing aramids.

In the course of this investigation, we have studied the relationship between the water solubility of polar organic solvents and their effectiveness as dye diffusion agents or flame retardant diffusion agents for aramids. It is well known that water-soluble polar organic solvents, such as dimethylformamide, dimethylsulfoxide, dimethylacetamide, methylpyrrolidone or ethylpyrrolidone, are effective dye diffusion promoters for aramids when used in a solvent system containing only a minor proportion of water, or no water at all. However, solvent-system dyeing procedures create possibilities of explosion, pollution, and solvent recovery. It is an object of the present invention to provide processes which use dye diffusion promoters as a minor proportion (about 0.5% to 6%) of the dye bath, as dyeing assistants. Such processes reduce or eliminate the problems mentioned immediately above, and can effect a major reduction in cost and a major improvement in convenience.

In studying candidate amide diffusion promoters as assistants for dyeing or flame retarding aramids, we have discovered that water-soluble polar solvents are ineffective when used in a low concentration, such as 0.5% to 6.0% by weight. This is because little of the water-soluble solvent enters into the aramid fiber to promote swelling and diffusion of dye and/or flame retardant into the fiber; the major portion remains in the dyebath, where it is ineffective. We have discovered that for aramid diffusion agents to be effective, they must have low water solubility under the conditions of dyeing, but not be completely insoluble, since some solubility is necessary for the diffusion agent to reach and penetrate the aramid fibers. Thus, a balance between hydrophilic and lipophilic character is necessary. This property can be measured by water solubility tests, but data are not available in the literature for solubility of amide dye diffusion agents at the temperatures and other conditions used in dyeing.

The hydrophile/lipophile balance can be measured approximately in an homologous series of monoamides by certain secondary properties such as molecular weight, number of carbon atoms in the structure, or percent nitrogen content, since the nitrogen-containing amide groups are responsible for the hydrophilic character of the molecule. However, we have chosen to use a standardized dyeing procedure which measures depth of dyeing and the extent of swelling of the aramid fiber, designated as the "Swelling Value". This procedure, and the criteria for its use, are described in detail below.

It is an object of the present invention to provide a process for dyeing an aramid fiber such as Nomex®. It is also an object to provide a process for simultaneously dyeing and not detracting from the inherent strength of the aramid fibers. It is also an object to provide a process suitable to conventional equipment such as pressure jets, dye becks or similar machines. It is particularly an object to provide a process for the preparation of dyed, "super FR" Nomex® fabrics of high LOI of 37%–44% as described in the Cates et al patent U.S. Pat. No. 4,759,770.

SUMMARY OF THE INVENTION

Disclosed is a process for dyeing or flame retardant treating, or if preferred, both dyeing and simultaneously improving the flame-resistant properties of poly(m-phenyleneisophthalamide) fibers. The process includes the steps of introducing the fiber into a fiber dyeing solution containing a tinctorial amount of at least one dye in combination with selected dye diffusion promoters as defined below, and, optionally, at least one flame retardant, especially chloroalkyl diphosphate esters such as Antiblaze 100, optionally also containing sodium nitrate, then heating the fiber and solution at a temperature and for a sufficient period of time to dye and flame retardant treat (when flame retardant is present) the fibers.

In another embodiment of the invention, we have discovered the advantages of a two-step process in which a dye diffusion promoting agent is applied in an initial step prior to further processing such as dyeing or treating with a flame retardant or both. Initial treatment with a dye diffusion promoting agent leaves residual promoting agent on the aramid fabric, which may then be sold to processors in this condition for subsequent dyeing and/or flame retardant treating. The separate application of the dye diffusion promoting agent prior to dyeing sometimes results in a better dyeing than does the use of the dye diffusion promoting agent directly with the dye(s) as well as higher levels of flame resistance.

The two-step process allows for the dyeing of fully or partially constructed garments by first treating the fabric with the dye diffusion promoting agent, an effective amount of which remains on the fabric. A garment is then fully or partially constructed and dyed to the appropriate shade.

A carrier in amounts preferably up to 10% by weight may be used in conjunction with the dye diffusion promoter. These carriers are conventionally used in the art and include ethylene glycol phenyl ether (Dowanol EPH) and butyl/propyl phthalimide (Carolid NOL).

Certain ultraviolet absorbers such as Ultrafast 830 when included in the dyeing system produced an improvement of half a grade (on the gray scale) in lightfastness. An additional half grade improvement is usually obtained by a topical post-treatment with a UV absorber.

Another aspect of this invention is that dyeing and flame retardant fixation can be obtained at atmospheric pressure and at temperatures below the boil. Useful color and flame retardant fixation can be achieved at 98° C. with somewhat lower degrees of color fixation when the same treatment is applied at 82° C.

Flame retardants are applied in a range of about 3% to about 20% based on weight of fabric for the exemplified flame retardant Antiblaze 100, with a preferred range of from 6% to 15%, and a most preferred range of from 6% to 9%.

Amide dye diffusion and/or flame retardant promoting agents may be unsubstituted, monosubstituted or disubstituted, containing from 7 to 20, desirably 10 to 12, carbon atoms attached to the nitrogen atom. The amide dye diffusion agents suited to the process of the present invention are those exhibiting, a swelling value of at least 1.5%, grater than the control as described below, and exclude both N-cyclohexyl-2-pyrrolidone and N-octyl-2-pyrrolidone.

The dye diffusion and/or flame retardant promoting agents of this invention desirably cause an enhanced uptake of dye and/or flame retardant by the aramid fabric, and result in a swelling value as herein defined at lest 1.5% greater than the control. This convenient procedure serves to distinguish the more effective and useful amides from relatively ineffective and less useful amides as characterized by less swelling.

The test was conducted as follows: A bath weighing 200 g was prepared containing 0.2 g of Acid Blue 62 and 6 g of the candidate dye diffusion promoting agent. In this aqueous bath, 10 g of weighed Nomex fabric, conditioned at 70° F. and 65% RH, was dyed at 130° C. for 1.5 hours.

After dyeing, the fabric was rinsed in warm tap water, and then scoured in fresh tap water at 100° C. in the Ahiba Vistamatic apparatus for 15 minutes. The bath was cooled and discarded, and the fabric was rinsed in fresh tap water, squeezed to remove excess liquid and allowed to air dry overnight. The fabric was then rinsed twice in cold, fresh acetone, air dried, and conditioned prior to weighing. The change in weight compared with the initial conditioned weight is the Swelling Value, with a positive value indicating a gain in weight, and a negative value indicating a loss.

This technique permits rapid selection of the more effective agents and provides useful information for assembling structure-activity relationships. For example, low-molecular weight pyrrolidones, benzamides and dimethylamides were unremarkable promoters. There were fairly narrow intervals in several homologous series over which effective dye or flame retardant promotion was observed. The benzamides, chosen as a specific sub-group of the amides are typical:

dimethylbenzamide—poor 9 carbons diethylbenzamide—good 11 carbons dipropylbenzamide—good 13 carbons dibutylbenzamide—door 15 carbons It will be apparent that variations on this process are possible, such as use of other flame retardants, or other temperatures or times.

Other effective flame retardants suited for use in the process and offering acceptable flame resistance and durability to laundering include halophosphate esters, phosphates and phosphonates of particular types. These include AB-100, a chloroalkyl diphosphate ester, AB-80, a trichloropropylphosphate, and DBBP, a dibutylbutylphosphonate (all products of Albright and Wilson); Fyrol CEF and Fyrol PCF, respectively trichloroethylphosphate and trichloropropylphosphate, and TBP, tributylphosphate (products of Stauffer Chemical Co.), XP 60A and XP 60, both halophosphate esters (products of Virkler); and HP-36, a halogenated phosphate ester available as a pale yellow, low viscosity liquid containing 35 to 37% bromine, 8–9.5% chlorine and 6–8% phosphorus (a product of Great Lakes Chemical Corporation).

The flame resistance/performance properties of fabrics dyed by the process of this invention are significantly improved, far better than if aftertreated with a flame-retardant finish applied from an aqueous solution following the dyeing operation. LOI values, as described in more detail below, may be as high as 41% for the simultaneously dyed and flame retarded T-455 Nomex® fabric product produced by the process of this invention. As a means of comparison, undyed T-455 Nomex® has an LOI of 27%.

Both dyeing and flame retarding are affected by the concentration of the dye diffusion promoting agents. As an illustration, we have obtained dye and ER fixation in this process using dye diffusion promoting agent concentrations of 10 to 120 percent on weight of fabric with best results at the 20 to 50 percent or higher level. Results are also affected by the liquor-to-fabric ratio. Typical liquor-to-fabric ratio for this work has been 15:1, although in production ratios as low as 5:1 may be used with 7:1 considered normal. Residual agent is removed by scouring at the boil. The results of dyeing experiments using a variety of dye diffusion promoting agents are described in Table 1.

Fibers suitable for the process of this invention are known generally as aromatic polyamides. This class includes a wide variety of polymers as disclosed in U.S. Pat. No. 4,324,706, the disclosure of which is incorporated by reference. Our experience indicates that not all types of aromatic polyamide fibers are equally well dyed by this process; some fibers are not affected sufficiently by the amide dye promoter to allow the dye to enter the fiber and are only surface stained, not fully dyed. Thus, the principal fibers amenable to the process of this invention are made from a polymer known chemically as poly(m-phenyleneisophthalamide), i.e., the meta isomer which is the polycondensation product of metaphenylenediamine and isophthalic acid. Below is a listing of fibers now commercially available identified by fiber name (usually a trademark) and producer:

| Fiber Name | Producer |
|---|---|
| Nomex | DuPont |
| Apyeil (5207) | Unitika |
| Apyeil-A (6007) | Unitika |
| Conex | Teijin |

Our experience indicates that fibers of the para isomer, poly(p-phenyleneterephthalamide) represented commercially by DuPont's Kevlar® and Enka-Glanzstoff's Arenka®, are usually stained or changed in color, but are not easily dyed by the process of this invention. Accordingly, as used in the text of this application and in the claims that follow, the expressions "aramid" and "aromatic polyamide fiber", when pertaining to the novel process of this invention, will signify the meta isomer unless otherwise specified.

Nomex® T-455, a blend of 95% Nomex and 5% Kevlar, is difficult to dye to a fully acceptable deep, even shade due to the presence of a minor amount of non-dyed para isomer leading to a "frosty" appearance of the dyed goods. We have found that the specific combination of amide promoters and basic dyes effectively colors the para isomer and eliminates "frostiness" of the blended fabric.

A preferred flame retardant is Antiblaze® 100 (Mobil Oil Corp.), CAS registry number 38051-10-4. It has the following structure:

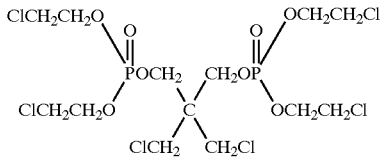

Flame retardant concentrations in the treatment bath are 0.5% to about 20% (based on weight of fabric) are contemplated. However, the upper limit as a practical matter will be determined by the degree of performance required balanced against the cost of the FR chemical or system used. Concentrations in the range of about 3% to about 20% have been shown to be effective in increasing LOI values.

Limiting Oxygen Index (LOI) is a method of measuring the minimum oxygen-concentration expressed as volume % needed to support candle-like combustion of a sample according to ASTM D-2863-77. A test specimen is placed vertically in a glass cylinder, ignited, and a mixture of oxygen and nitrogen is flowed upwardly through the column. An initial oxygen concentration is selected, the specimen ignited from the top and the length of burning and the time are noted. The oxygen concentration is adjusted, the specimen is re-ignited (or a new specimen inserted)., and the test is repeated until the lowest concentration of oxygen needed to support burning is reached.

DESCRIPTION OF THE PREFERRED EMBODIMENTS

The following examples offered are by illustration and not by way of limitation. All parts and percentages herein are given by weight unless otherwise specified.

Additional assessments, comparisons and other useful information suggest themselves from the examples that follow.

1. Dyeing—A bath weighing 200 g was prepared containing 0.2 g of Acid Blue 62 and 6 g of the candidate dye diffusion promoting agent. In this aqueous bath, 10 g of weighed Nomex fabric, conditioned at 70° F. and 65% RH, was dyed at 130° C. for 1.5 hours.

After dyeing, the fabric was rinsed in warm tap water, and then scoured in fresh tap water at 100° C. in the Ahiba Vistamatic apparatus for 15 minutes. The bath was cooled and discarded, and the fabric was rinsed in fresh tap water, squeezed to remove excess liquid and allowed to air dry overnight. The fabric was then rinsed twice in cold, fresh acetone, air dried, and conditioned prior to weighing. The change in weight compared with the initial conditioned weight is reported in Table 1 as the Swelling Value, with a positive value indicating a gain in weight, and a negative value indicating a loss.

2. Application of Flame Retardant—In Procedure A, dyeing and flame retarding were conducted simultaneously, using the dyeing procedure described above, but with the extra addition of 1 g of Antiblaze 100 to the bath.

In Procedure B, dyeing was conducted as described in the procedure described above, without flame retardant. After drying, the fabrics were rinsed twice in boiling water. The rinsed fabrics were then treated with flame retardant as follows: One gram of Antiblaze 100 was dispersed in 200 g of water with the aid of 0.2 g of Merpol HCS surfactant. The fabric was then heated in the dispersion of flame retardant for 1.5 hours at 130° C. The treated fabric was then rinsed with water and acetone as described above in order to determine the Swelling Value.

Results

The results of dyeing experiments, and of combined dyeing and flame retarding experiments, are summarized in Table 1.

TABLE 1

Comparison of Dye Diffusion Promoting Agents

| | | | | Dyed Only | Dyed and Flame-Retarded | | | | |
|---|---|---|---|---|---|---|---|---|---|
| | | | | | Procedure A | | Procedure B | | |
| No. | Chemical | No. of Carbons | Depth of Dyeing | Swelling Value % | Add-on % | P % | Swelling Value % | P % | LOI % |
| 1. | Blank (control) | 0 | v. light | −1.5 | −1.6 | 0.01 | — | — | — |
| 2. | Lauramide | 12 | v. light | — | — | — | — | — | — |
| 3. | Butylbenzamide | 11 | medium | 6.1 | — | — | — | — | — |
| 4. | Cyclohexylbenzamide | 13 | light | — | — | — | — | — | — |
| 5. | Dibutylformamide | 9 | dark | 1.5 | 6.9 | .16 | 4.3 | .45 | 40.7 |
| 6. | Dipropylacetamide | 8 | medium | 2.6 | 4.4 | .41 | — | — | — |
| 7. | Dibutylacetamide | 10 | dark | 4.5 | 6.9 | .10 | 3.5 | .26 | 34.4 |
| 8. | Dipropylpropionamide | 9 | dark | 3.9 | 6.0 | .36 | — | — | — |
| 9. | Dibutylpropionamide | 11 | v. light | −.7 | .1 | .01 | −1.2 | .02 | 28.1 |
| 10. | Dipropylbutyramide | 10 | light–med. | 1.8 | — | — | — | — | — |
| 11. | Dibutylbutyramide | 12 | v. light | −.5 | — | — | — | — | — |
| 12. | Dimethylhexamide | 8 | med.–dark | .9 | 7.9 | .66 | — | — | — |
| 13. | Diethylhexamide | 10 | medium | 3.3 | 4.0 | .06 | 1.1 | .08 | 28.2 |
| 14. | Hallcomid H-8-10+ | 10–12 | medium | 3.9 | — | — | — | — | — |
| 15. | Dimethylcaprylamide | 10 | dark | 2.2 | 5.9 | .08 | 2.7 | .22 | 36.2 |
| 16. | Dimethylcapramide | 12 | v. light | −.2 | −.8 | .02 | −1.0 | .02 | 27.8 |
| 17. | Dimethylbenzamide | 9 | v. light | −.5 | 1.5 | .16 | 1.1 | .16 | 34.4 |
| 18. | Diethylbenzamide | 11 | dark | 3.6 | 11.1 | .56 | — | — | — |
| 19. | Dipropylbenzamide | 13 | dark | 7.2 | 7.3 | .07 | 4.0 | .20 | 32.9 |
| 20. | Dibutylbenzamide | 15 | v. light | −.9 | −.5 | .01 | −1.2 | .01 | 28.1 |
| 21. | Ethylpyrrolidone | 6 | v. light | −.7 | −.6 | .03 | — | — | — |
| 22. | Cyclohexylpyrrolidone | 10 | dark | 5.5 | 10.2 | .59 | 4.4 | .40 | 40.4 |
| 23. | n-Octylpyrrolidone | 12 | dark | .1 | 3.9 | .07 | 4.3 | .41 | 36.7 |
| 24. | Benzoylmorpholine | 11 | v. light | −.8 | — | — | — | — | — |
| 25. | Dihexanoylpiperazine | 16/2 | medium | — | — | — | — | — | — |

+Dimethylamide of mixed $C_8$ and $C_{10}$ acids.

1. Dyeing—Among the monosubstituted amides (Nos. 2–4), only the butylbenzamide showed some promise as a dye diffusion agent. Among the disubstituted amides (Nos. 5–20), and the pyrrolidones (Nos. 21–23), which can also be considered disubstituted amides), the following dye diffusion promotion agents all produced dark dyeing and are of special interest:

| No. | Chemical | No. of Carbons | Swelling Value |
|---|---|---|---|
| 5 | Dibutylformamide | 9 | 1.5 |
| 7 | Dibutylacetamide | 10 | 4.5 |
| 8 | Dipropylpropionamide | 9 | 3.9 |
| 12 | Dimethylhexamide | 8 | .9 |
| 15 | Dimethylcaprylamide | 10 | 2.2 |
| 18 | Diethylbenzamide | 11 | 3.6 |
| 19 | Dipropylbenzamide | 13 | 7.2 |
| 22 | Cyclohexylpyrrolidone | 10 | 5.5 |
| 23 | n-Octylpyrrolidone | 12 | .1 |

These dye diffusion promoting agents all contain between 8 and 13 carbon atoms in their structure and show a positive dyed only swelling value. Those amides containing less than 7 or more than 14 carbon atoms (Nos. 21 and 20) were ineffective, as were all the structures producing a negative dyed-only swelling value. It thus appears that a combination of two properties—7 to 14 carbon atoms in the molecular structure and a positive swelling value—is sufficient to define an effective class of dye diffusions promoting agents for fibers such as Nomex.

2. Dyeing and Flame Retarding—Two separate procedures for dyeing and flame retarding have been described above. In Procedure A, dyeing and flame retarding were conducted simultaneously, while in Procedure B, the flame retardant was applied at a later step. Examination of the results in the last five columns of Table 1 indicates that Procedure B is surprisingly effective in imparting enhanced flame resistance to Nomex Fibers, in spite of the fact that much of the diffusion promoting agent-has been removed by scouring. This result suggests that the diffusion promoting agent has produced a change in the structure of the Nomex which makes it easier for flame retardant, and possibly dyes, to enter the fiber. Procedure B is useful for a two-step process for flame retarding Nomex or for the printing of patterns on Nomex fabric dyed to a solid background shade.

What is claimed is:

1. A process of dyeing poly(m-phenyleneisophthalamide) fabric comprising:

(a) dyeing the fabric at a temperature in the range of about 100° C. to about 150° C. and elevated pressure in a fiber-dyeing solution containing a tinctorial amount of at least one dye and a dye diffusion promoting amount of an aromatic amide having 7 to 14 carbon atoms capable of increasing the swelling value of the fabric at least 1.5%, then (b) heating the fabric while in contact with the solution until the desired degree of dyeing is attained.

2. The process of claim 1 in which the dye is an acid, direct or disperse dye.

3. The process of claim 1, in which the amount of dye diffusion promoting agent is from about 10 to 120 percent by weight of fabric.

4. The process of claim 1, in which the ratio of dyeing solution to fabric is from about 40:1 to about 4:1 by weight.

5. The process of claim 1, including the additional step of (3) removing any residual amide from the fabric.

6. The process of claim 1, in which the fabric is dyed at a temperature of about 130° C.

7. The process of claim 1, in which the fabric is dyed for about 15 minutes to about 2 hours.

8. The process of claim 1, in which the fabric is a blend of poly(m-phenyleneisophthalamide) and poly(p-phenyleneterephthalamide) fibers, and the dye is a basic dye.

9. A process of dyeing a blend of poly(m-phenyleneisophthalamide) and poly(p-phenyleneterepthalamide) fibers comprising:

(a) treating the fibers at a temperature in the range of about 100° C. to about 150° C. and elevated pressure in a solution containing a tinctorial amount of a basic dye and a dye diffusion promoting amount of an aromatic amide having 7 to 14 carbon atoms capable of increasing the swelling ratio of the value at least 1.5%, then (b) heating the fabric in the solution until the poly(m-phenyleneisophthalamide) fibers have been dyed and the poly(p-phenyleneterephthalamide) fibers have been strained.

10. The process of claim 9, in which the fabric is a blend of 0 to 10% by weight of poly(p-phenyleneterephthalamide) fibers, balance poly(m-phenyleneisophthalamide) fibers.

11. The process of claim 9, in which the fabric is treated at a temperature of about 130° C.

12. The process of claim 9, in which the fabric is treated for about 15 minutes to about 2 hours.

13. A process of flame-retardant treating poly (phenyleneisophthalamide) fabric comprising:

(a) treating the fabric with flame retardant at a temperature in the range of about 100° C. to about 150° C. and elevated pressure in a fiber-treating solution containing a flame-retarding amount of at least one flame retardant and a flame retardant diffusion promoting amount of an amide having 7 to 14 carbon atoms capable of increasing the swelling fiber of the fabric at least 1.5% then (b) heating the fabric while in contact with the solution until the desired degree of flame retardant fixation is attained.

14. A method of dyeing aromatic polyamide fibers comprising pre-treating said fibers by contacting said fibers with a bath including a dye diffusion promoting agent comprising an aromatic amide having 7 to 14 carbon atoms capable of increasing the swelling value of said fibers at least 1.5%, followed by contacting said pre-treated fibers with a dye.

15. A method of flame-retardant treating aromatic polyamide fibers comprising pre-treating said fibers by contacting said fibers with a bath including a flame-retardant diffusion promoting agent comprising an aromatic amide having 7 to 14 carbon atoms capable of increasing the swelling value of said fibers at least 1.5%, followed by contacting said pre-treated fibers with a flame-retardant.

16. A method of dyeing and printing aromatic polyamide fibers comprising contacting the fibers with an aqueous dyebath including a functional amount of at least one dye and a dye diffusion promoting agent comprising an aromatic amide having 7 to 14 carbon atoms capable of increasing the swelling value at least 1.5%, then applying onto the fabric a print paste including at least one dyestuff, a print paste thickening agent, and water.

17. A method of dyeing aromatic polyamide fibrous material comprising contacting the fibrous material with an aqueous dye bath including a functional amount of at least one dye and a dye diffusion promoting agent comprising an N-substituted aromatic carbonamide or N,N-disubstituted aromatic carbonamide or mixture thereof, having 7 to 14 carbon atoms and capable of increasing the swelling value of the fibrous material at least 1.5%, and heating the fibrous material while in contact with the dyebath to fix the dye within the fibrous material.

18. A method of dyeing aromatic polyamide fibers comprising contacting the fibers with an aqueous dyebath comprising a functional amount of at least one dye and a dye diffusion promoting agent comprising an aromatic amide having 7 to 14 carbon atoms capable of increasing the swelling value at least 1.5%, and heating the fibers while in contact with the dyebath to fix the dye within the fibers.

19. A fibrous material or fiber of an aromatic polyamide that has been dyed with a dyebath comprising a mixture of a dye diffusion promoting agent and a dye soluble or dispersed with said agent, said agent comprising an aromatic amide having 7 to 14 carbon atoms capable of increasing the swelling value at least 1.5%.

20. A method of treating aromatic polyamide fibers with a flame retardant comprising contacting the fibers with a bath comprising a functional amount of the flame retardant and a flame retardant diffusion agent comprising an aromatic amid having 7 to 14 carbon atoms capable of increasing the swelling value at least 1.5%, and heating the fibers while in contact with the bath to fix the flame retardant within the fibers.

21. A fibrous material or fiber of an aromatic polyamide that has been treated with a flame retardant bath comprising a mixture of a flame diffusion agent and a flame retardant soluble or dispersed with said agent, said agent comprising an aromatic amide having 7 to 14 carbon atoms capable of increasing the swelling value at least 1.5%.

* * * * *